US005992666A

United States Patent [19]

Wu

[11] Patent Number: 5,992,666

[45] Date of Patent: Nov. 30, 1999

[54] SEALING CAP FOR A VACUUM SEAL CONTAINER

[76] Inventor: Mao Sheng Wu, No. 42-21, Peidao Li, Tanshui Chen 251, Taipei, Taiwan

[21] Appl. No.: 09/009,856

[22] Filed: Jan. 21, 1998

[51] Int. Cl.[6] ..... B65D 31/04

[52] U.S. Cl. ..... 220/212; 220/240; 215/228; 215/262; 215/270

[58] Field of Search ..... 220/212, 231, 220/240, 203.11, 203.23, 203.27, 203.28, 203.29, 367.1, 374; 215/228, 260, 262, 270, 311, 315

[56] References Cited

U.S. PATENT DOCUMENTS

| | | | |
|---|---|---|---|
| 5,406,992 | 4/1995 | Miramon | 215/228 X |
| 5,546,997 | 8/1996 | Miramon | 215/228 X |
| 5,558,243 | 9/1996 | Chu | 220/212 |
| 5,651,470 | 7/1997 | Wu | 220/212 |
| 5,692,632 | 12/1997 | Hsieh et al. | 220/212 |
| 5,779,082 | 7/1998 | Miramon | 220/212 |

*Primary Examiner*—Stephen K. Cronin
*Attorney, Agent, or Firm*—Rosenberg, Klein & Bilker

[57] ABSTRACT

A sealing cap fastened to a vacuum seal container and controlled to extract air out of vacuum seal container, the sealing cap including a cap body unit fastened to the vacuum seal container, and an extracting unit mounted in the cap body and controlled to extract air out of the vacuum seal container by reciprocating a control cap of the extracting unit with the hand, the air passage being automatically sealed by a flap, which is forced into the close position by atmospheric pressure, the vacuum status of the vacuum seal container being released when a control cap of the air extracting unit is turned in one direction and pressed down, the cap body having a bottom side covered with a rubber disk which fits different spout sizes and shapes, the rubber disk being secured to the cap body by a T-cap and a sponge between the T-cap and the rubber disk, the rubber disk having a convex flange of V-shaped cross section around the periphery, which prohibits the rubber disk from being forced to curve inwards and to escape out of position, the T-cap being adapted to prevent the rubber disk from being forced inwards by atmospheric pressure and to enable air to get into the inside of the container in all directions when releasing the vacuum status of the container, the T-cap and the sponge filtering and buffering air passes through to prevent powdered material from being adhered to the rubber disk in order to maintain its function of vacuum preservation.

1 Claim, 9 Drawing Sheets

SEALING CAP FOR A VACUUM SEAL CONTAINER

BACKGROUND OF THE INVENTION

The present invention relates to a sealing cap for vacuum seal containers which fits container mouths of different sizes and shapes, and more particularly to such a sealing cap which automatically extracts air out of the vacuum seal container when reciprocating a control cap. The sealing cap is equipped with a rubber disk which fits different container spouts. A sponge and a T-cap are fastened to the cap body of the sealing cap to secure the rubber disk in place, and to filter and buffer air passing through.

FIG. 1 shows a sealing cap fastened to a vacuum seal container 300, and operated to extract air out of the vacuum seal container 300. The sealing cap comprises a cap body 100, a gasket 101 retained between the cap body 106 and the container 300, and a valve 102 mounted on the gasket 101. When in use, an extracting pump 200 is attached to the cap body 100, and operated to extract air out of the container 300 through the valve 102. When releasing the vacuum status of the container 300, the valve 102 must be opened by pulling. This structure of sealing cap is not durable in use because the gasket 101 wears quickly with use and tends to be forced inwards by atmospheric pressure, causing an air leakage . Another drawback of this structure of sealing cap is that the cap body fits only circular container mouths. Furthermore, When opening the valve 102, powdered material which is contained in the container 300 is forced to splash by a rush flow of air.

SUMMARY OF THE INVENTION

The present invention provides a sealing cap for a vacuum seal container which automatically extracts air out of the vacuum seal container when reciprocating a control cap of the extracting unit with the hand. According to one aspect of the present invention, the sealing cap comprises a cap body unit fastened to the vacuum seal container, and an extracting unit mounted in the cap body and controlled to extract air out of the vacuum seal container. The cap body unit is comprised of a cap body, a rubber disk, a sponge, a T-cap, a flap, a pressure member, and a ring cap. The air extracting unit is comprised of a piston, a spring, and a control cap. When reciprocating the control cap with the hand the piston is moved up and down to extract air out of the vacuum seal container. The air passage is opened, enabling outside air to pass to the inside of the vacuum seal container when the control cap is turned in one direction and then pressed down. According to another aspect of the present invention, a rubber disk is attached to the cap body at the bottom side. The rubber disk has a flange curved downwards along its border for positioning, which prohibits the rubber disk from being forced to curve inwards and to escape out of position. According to still another aspect of the present invention, The T-cap is adapted to prevent the rubber disk from dropping down and to enable air to get into the inside of the container in all directions without causing the storage items to be forced to scatter by a rush flow of air when it is opened. Furthermore, the T-cap and the sponge filter air passing through and buffer its pressure to prevent powdered material from being adhered to the rubber disk in order to maintain its function of vacuum preservation.

FIGS. from 5A to 5C show the operation of the present invention.

Figure 6:
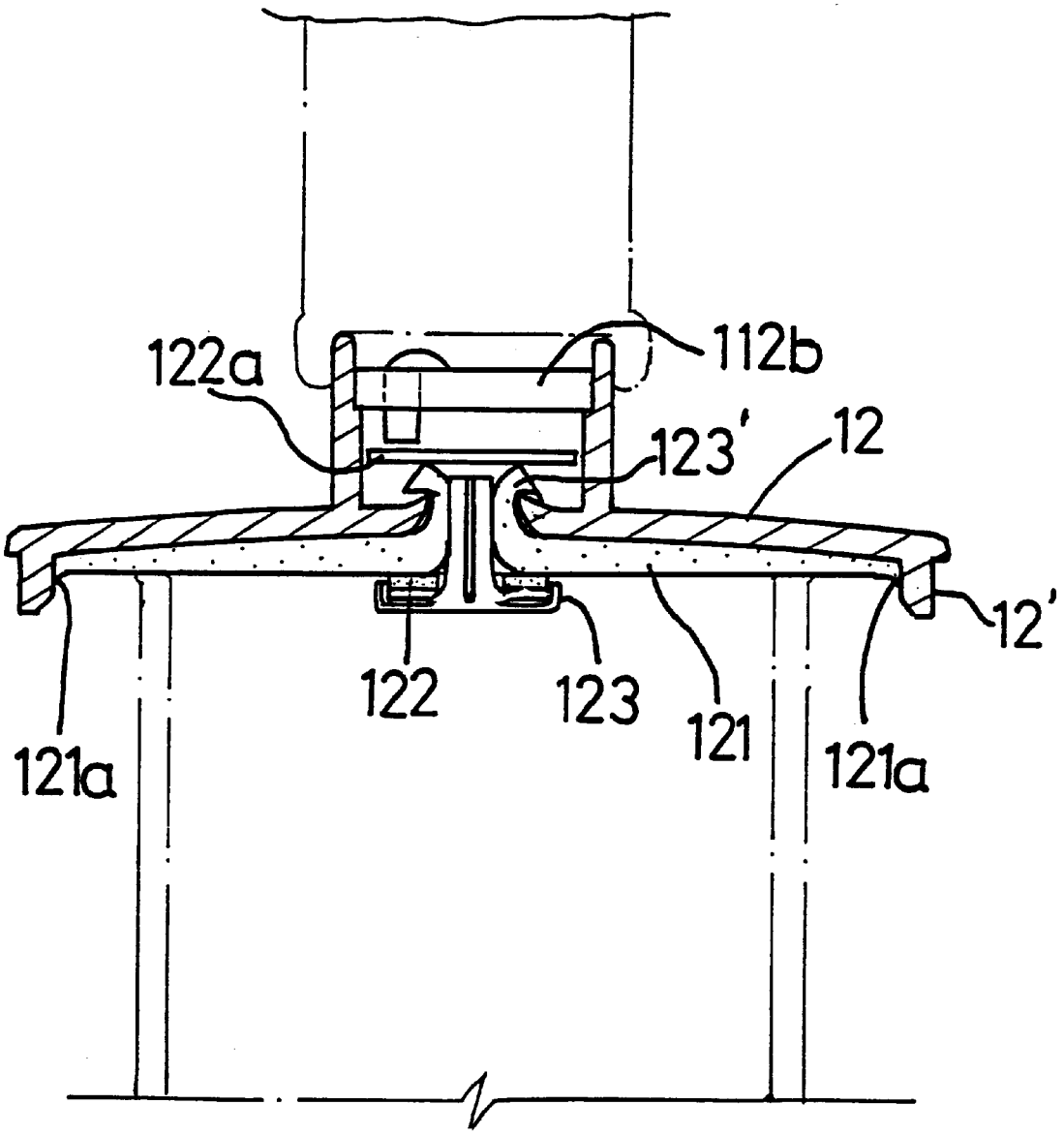

FIG. 6 shows an alternate form of the present invention.

DESCRIPTION OF THE REFERENCE CODES

| | | | |
|---|---|---|---|
| 1 | cap body unit | 11 | outer upright tube |
| 111 | inner upright tube | 112 | seat |
| 112a | flap | 112b | pressure member |
| 113 | coupling flange | 114 | gap |
| 115 | ring cap | 115a | coupling rod |
| 115b | locating notch | 12 | cap body |
| 121a | convex flange | 12' | coupling flange |
| 121 | rubber disk | 122 | sponge |
| 123 | T-cap | 2 | air extracting unit |
| 21 | control cap | 22 | piston |
| 23 | spring | 22a | bottom flange |
| 22b | upper flange | 123' | neck |
| 22c | rubber seal ring | | |
| 221;222;223;224; | air gaps | 225 | top notch |
| 226 | annular groove | 21a | inside coupling flange |
| 21b | inside locating rod | 400 | container |

DETAILED DESCRIPTION OF THE PREFERRED EMBODIMENT

Referring to FIGS. 2, 3, 3A and 4, a sealing cap for a vacuum seal container in accordance with the present invention is generally comprised of a cap body unit 1, and an air extracting unit 2.

cap body unit 1 is comprised of a cap body 12. The cap body 12 comprises an inner upright tube 111 perpendicularly raised from the top, an outer upright tube 11 perpendicularly raised from the top around the inner upright tube 111, a seat 112 defined within the inner upright tube 111, a split coupling flange 113 raised around the outer upright tube 11 near the top, two gaps 114 defined at the split coupling flange 113 at two opposite sides, a center air hole 121*a* at the center of the seat 112, and a downward coupling flange 12' raised from the bottom side near the border. A flap 112*a* and a pressure member 112*b* are mounted in the seat 112 inside the inner upright tube 111 of the cap body 12. A ring cap 115 is covered on the outer upright tube 11 and supported on the split coupling flange 113, having two locating notches 115*b* bilaterally disposed on the inside, and two downward coupling rods 115*a* respectively engaged into the gaps 114 in the split coupling flange 113 of the cap body 12. A rubber disk 121 is mounted within the downward coupling flange 12' at the bottom side of the cap body 12, having a neck 123' at the center inserted into the center air hole 121*a* on the seat 112 of the cap body 12, and a convex flange 121*a* around the periphery. A T-cap 123 which has a crossed stem raised from the center of a disk-like body thereof is fastened to the neck 123' of the rubber disk 121 at the bottom. A sponge 122 is mounted around the crossed stem of the T-cap 123 and retained between the rubber disk 121 and the disk-like body of the T-cap 123.

The air extracting unit 2 comprises a control cap 21, a piston 22, and a spring 23. The piston 22 is mounted within the outer upright tube 11 of the cap body 12, comprising an outward bottom flange 22*a* raised around the periphery at the bottom, an outward upper flange 22*b* raised around the periphery above the outward bottom flange 22*a,* a rubber seal ring 22*c* mounted around the periphery between the outward upper flange 22*a* and the outward upper flange 22*b,* two top notches 225 bilaterally disposed at the top, an inside annular groove 226 formed at the inside wall near the top, and a plurality of air gaps 221;222;223;224 equiangularly spaced at the outward upper flange 22*b*. The spring 23 is mounted around the piston 22 within the outer upright tube 11 of the cap body 12, and stopped between the ring cap 115 and the outward upper flange 22*b* of the piston 22. The control cap 21 is covered on the piston 22 above the ring cap 115, comprising an inside coupling flange 21*a* forced into engagement with the inside annular groove 226 on the piston 22, and two inside locating rods 21*b*.

Figure 1:
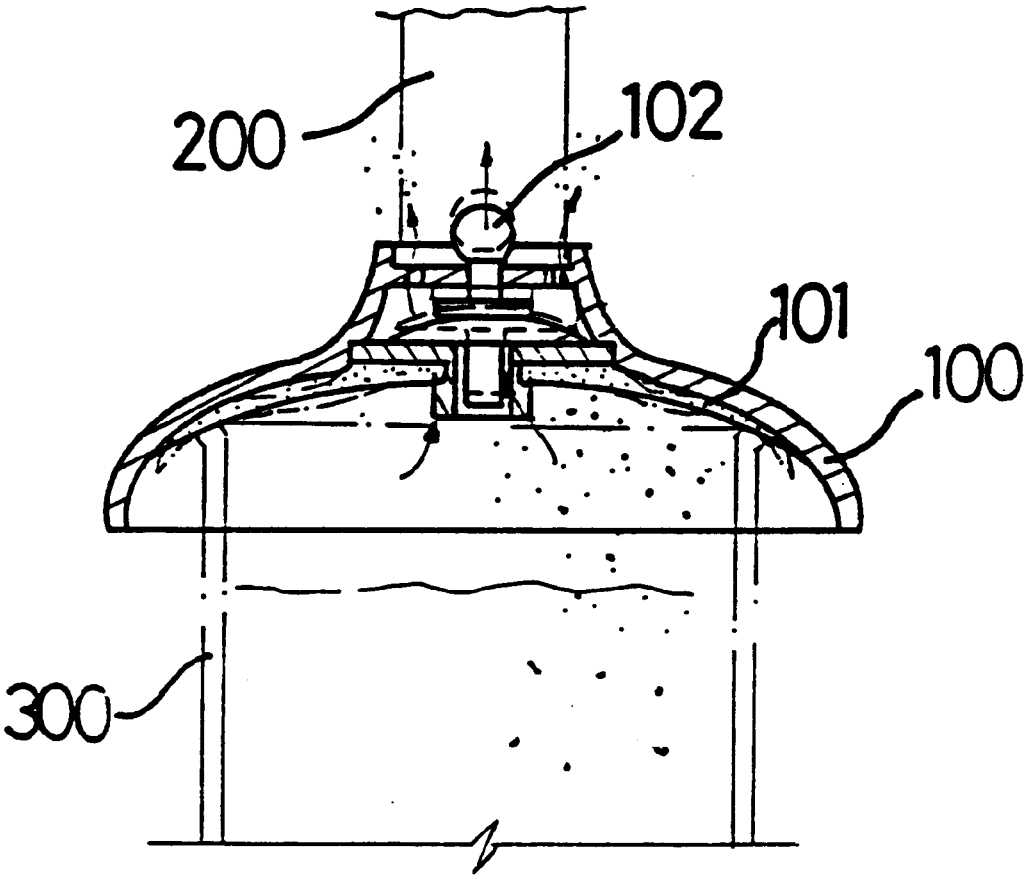
FIG. 1 is a sectional view showing a sealing cap fastened to a vacuum seal container according to the prior art.
Figure 2:
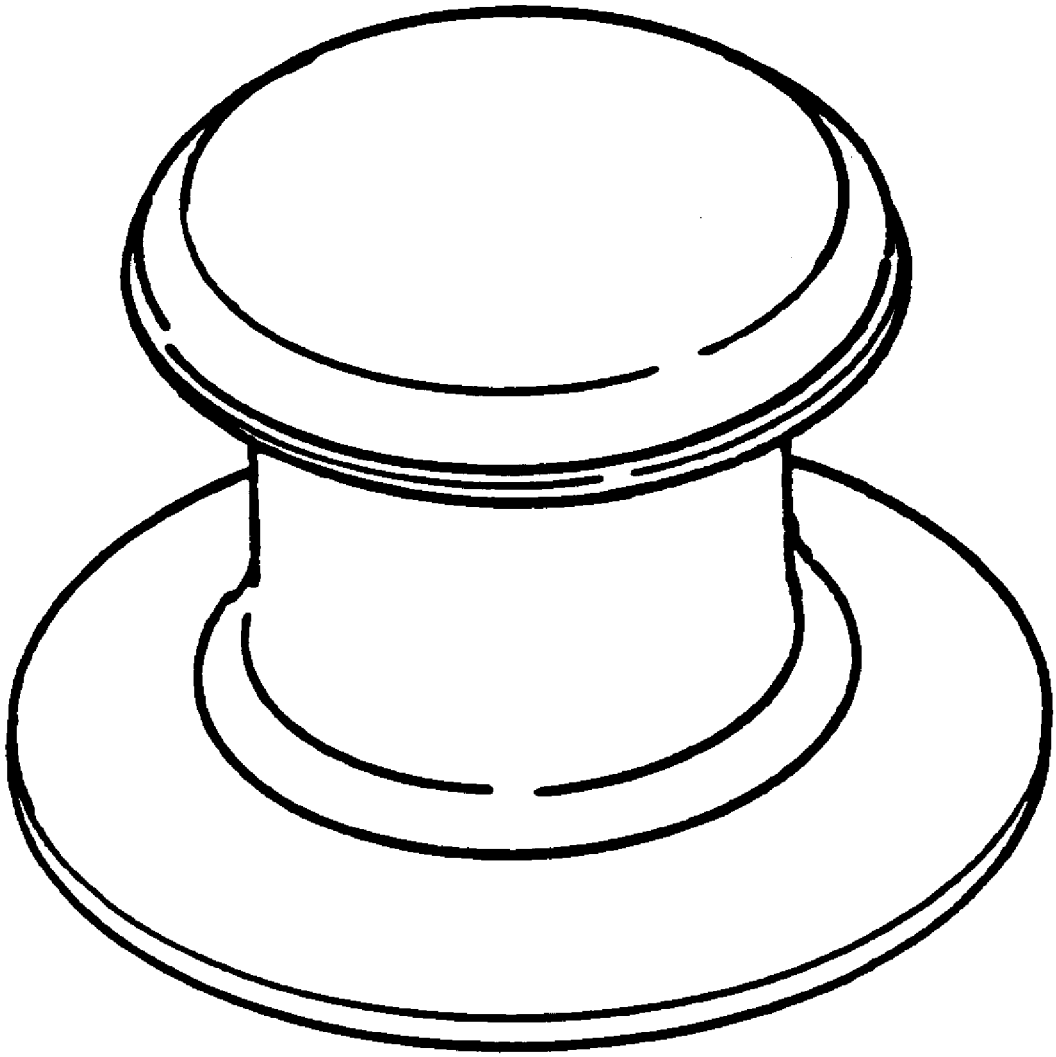
FIG. 2 is an elevational view of a sealing cap according to the present invention.
Figure 3:
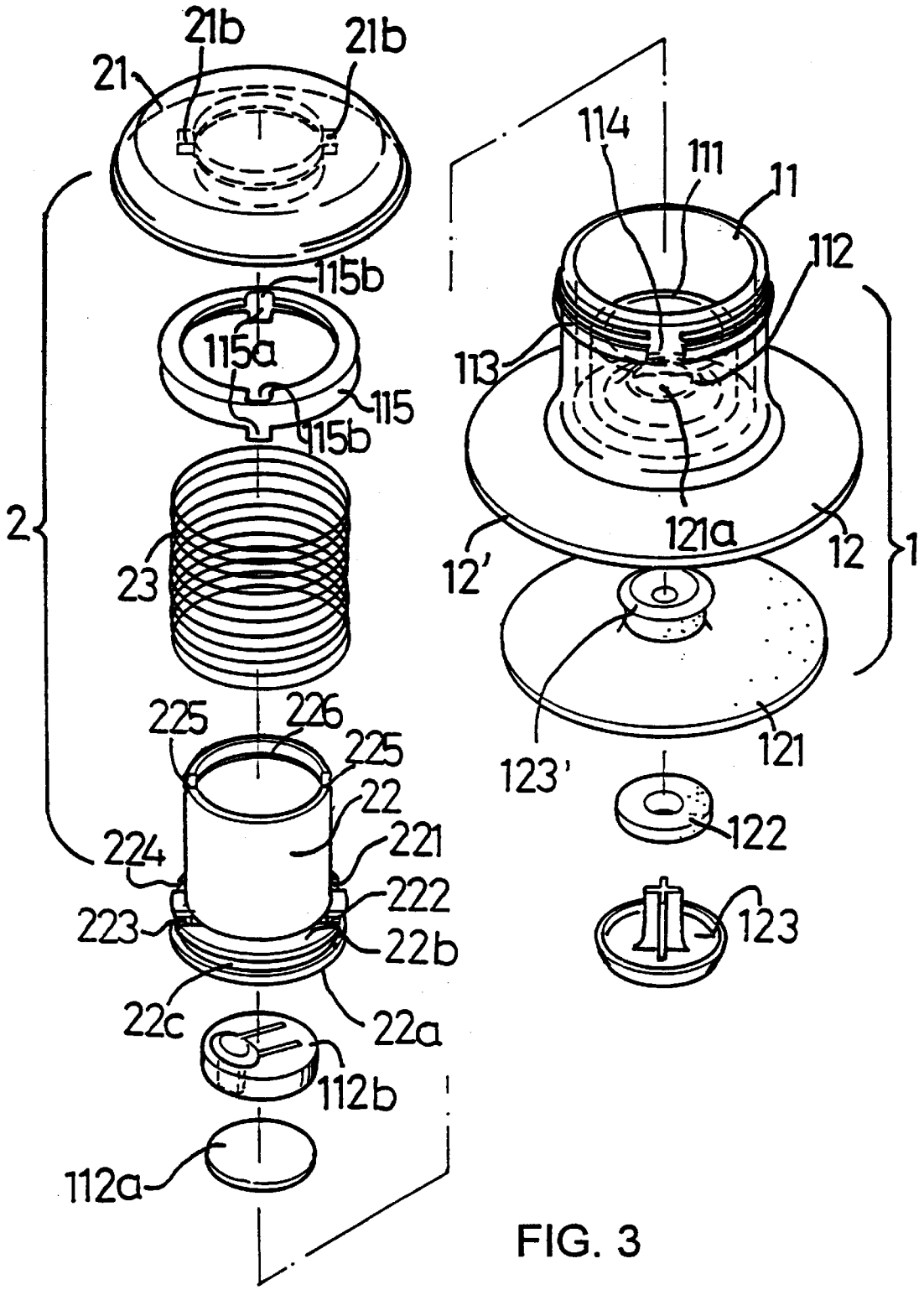
FIG. 3 is an exploded view of the sealing cap shown in FIG. 2.
Figure 3A:
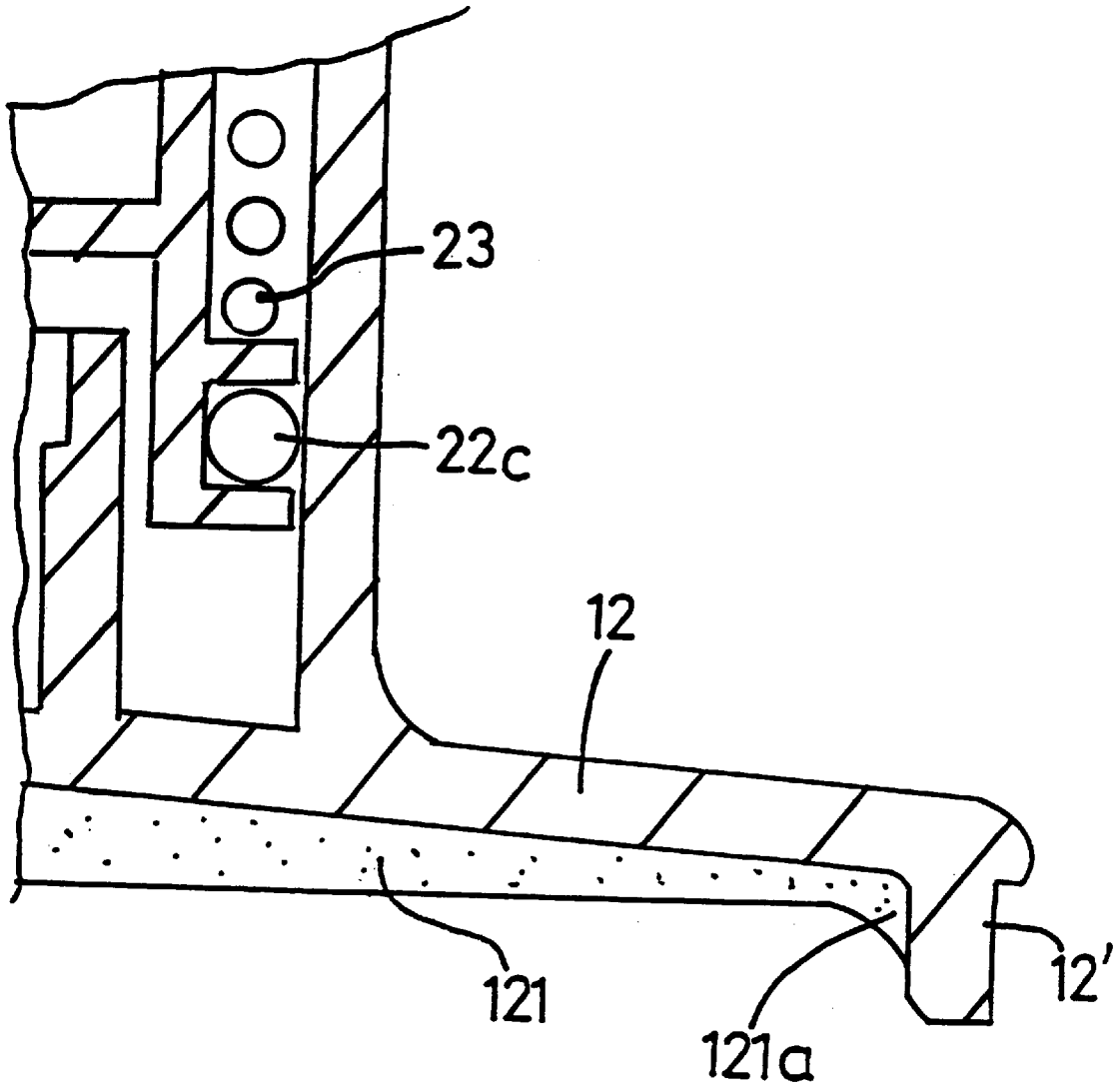
FIG. 3A is a sectional view of a part of the sealing cap shown in FIG. 2.
Figure 4:
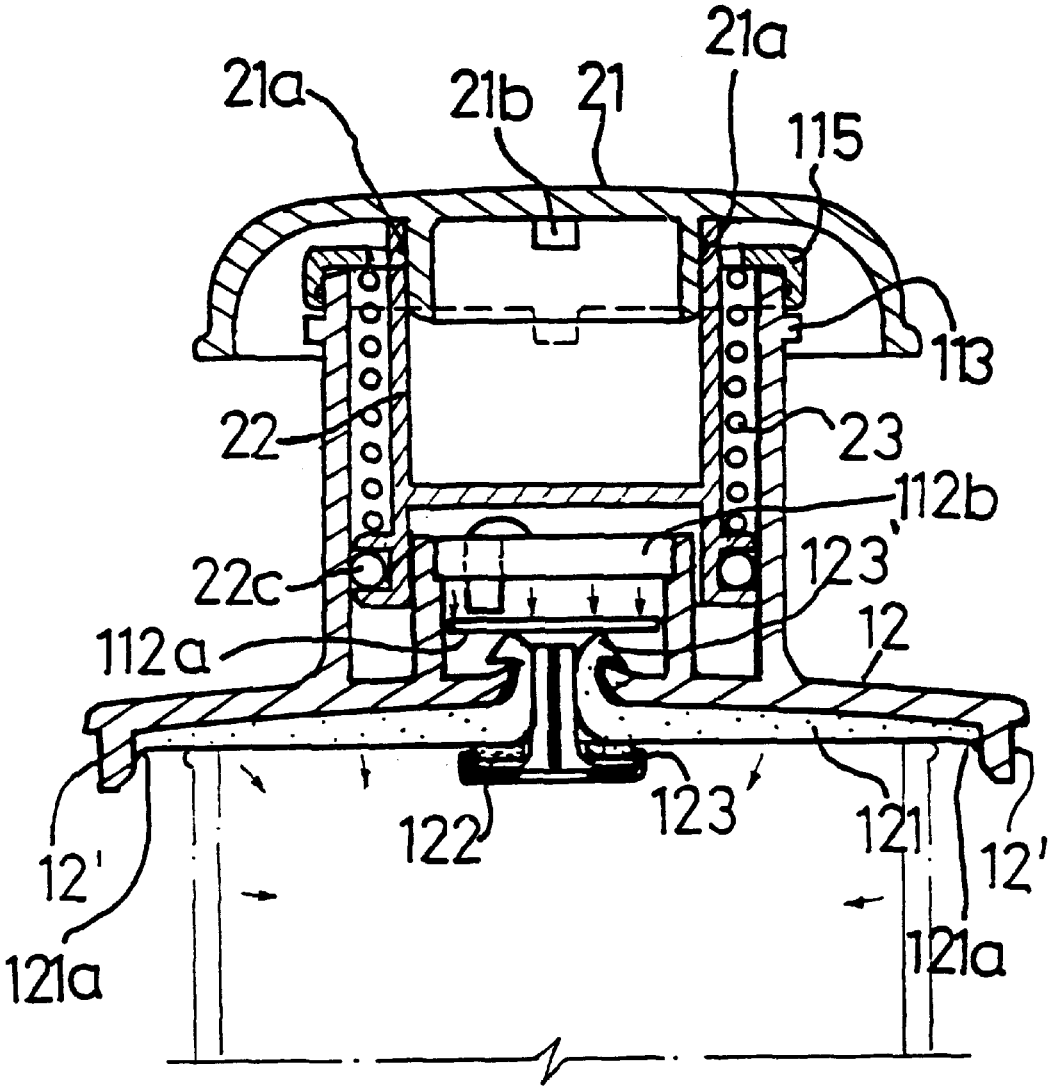
FIG. 4 is a sectional view of the present invention, showing the sealing cap fastened to a vacuum seal container.
Figure 5A:
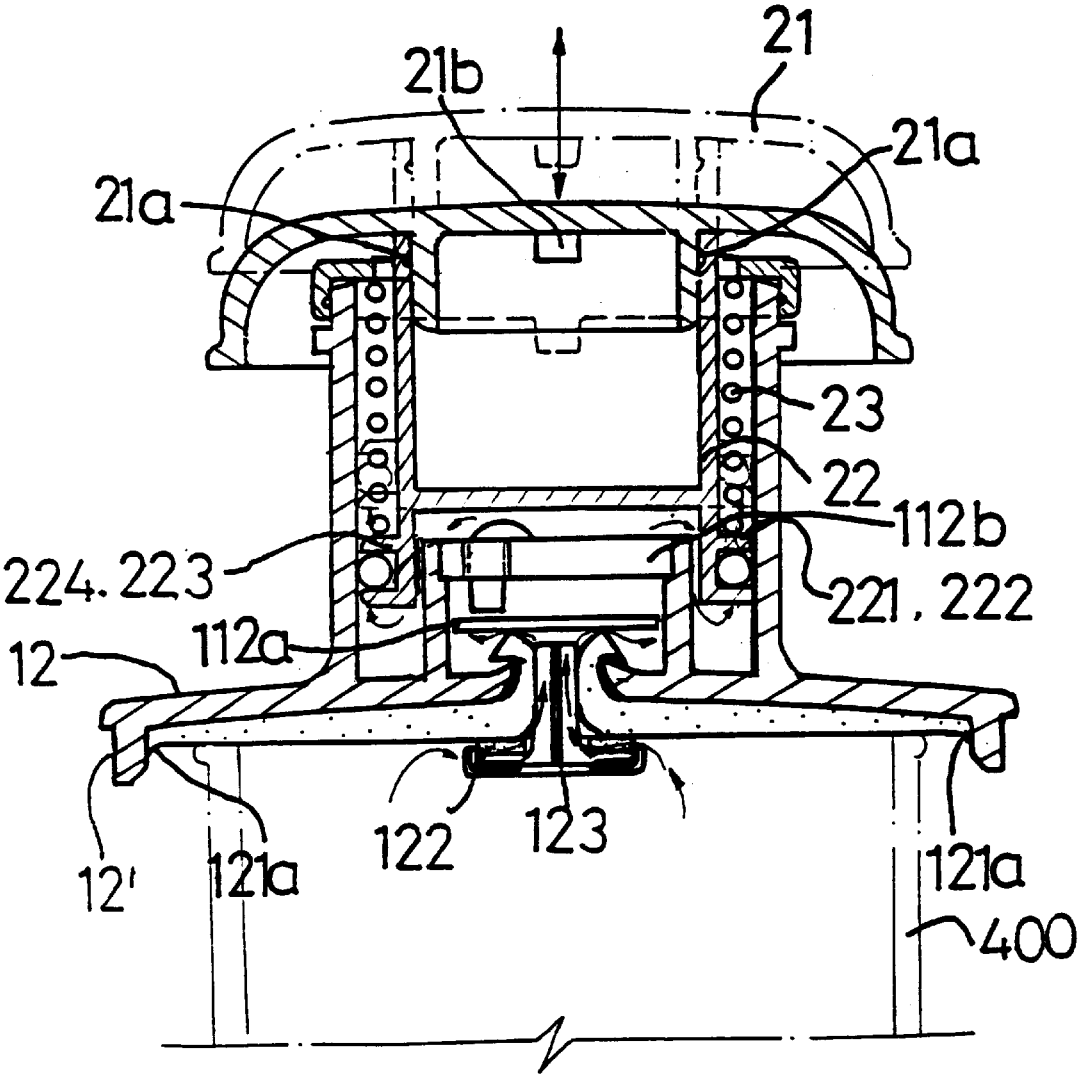
Figure 5B:
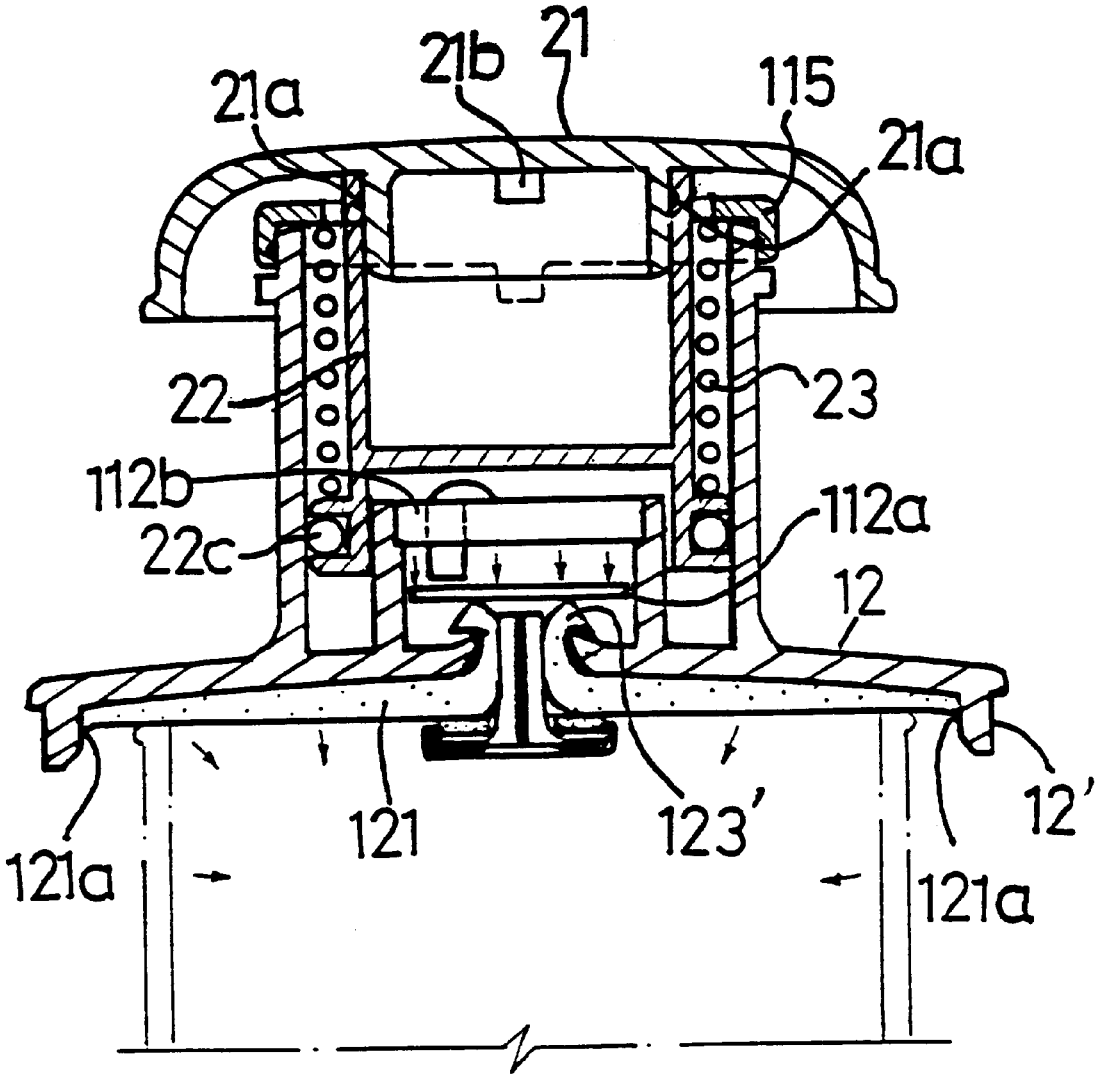
Figure 5C:
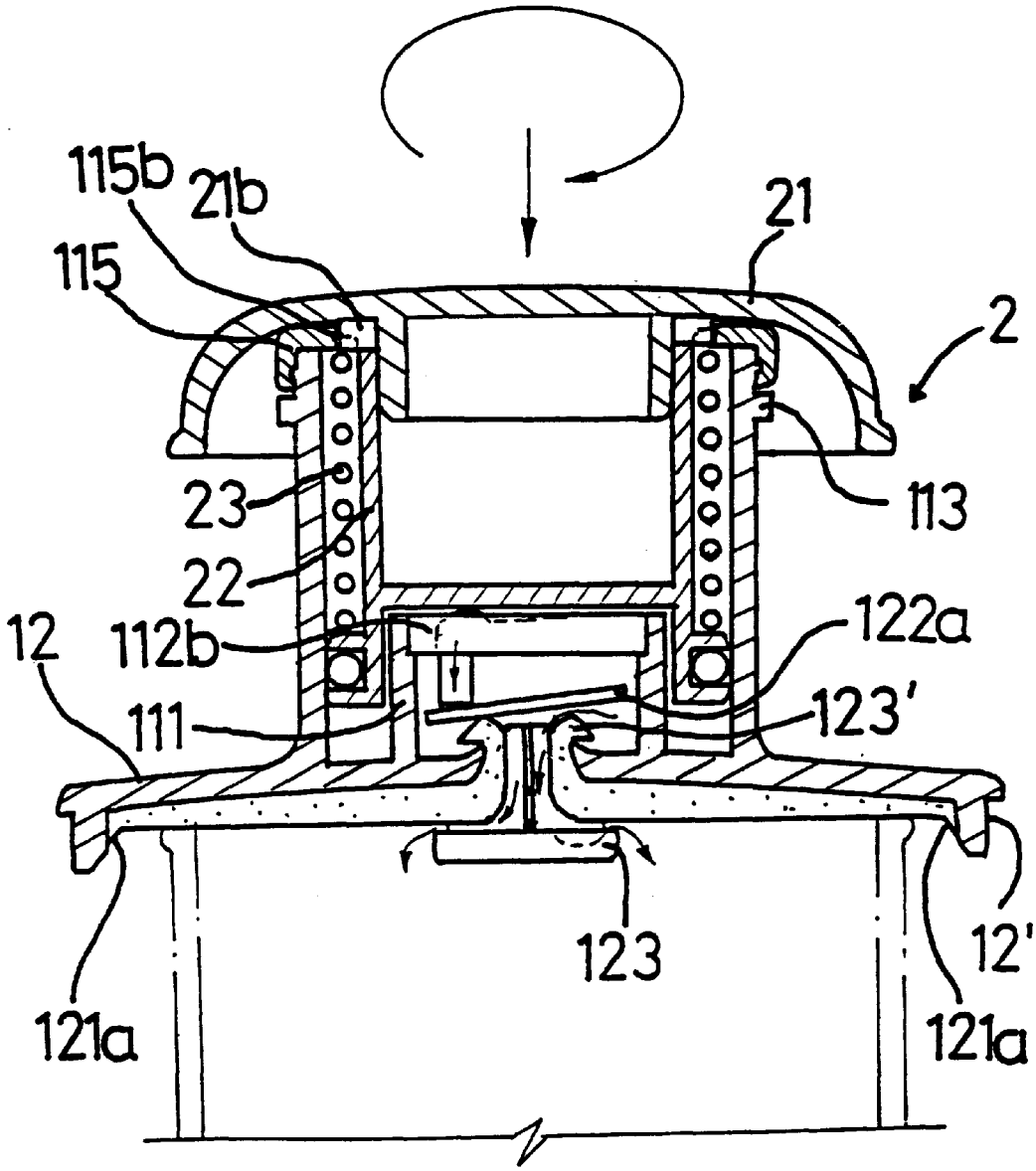

Referring to FIG. 5, after the sealing cap has been fastened to a container 400, the control cap 21 is reciprocated with the hand, causing the piston 22 to be moved up and down within the outer upright tube 11 of the cap body 12, and therefore air is extracted from the container 400 and carried out of the sealing cap through the air gaps 221;222;223;224 (see FIG. 5A). It indicates that the vacuum status has been obtained when pumping repeatedly until strong resistance is felt. When releasing the vacuum status of the container 400, the control cap 21 is turned in one direction to move the inside locating rods 21*b* into alignment with the locating notches 115*b* on the ring cap 115, permitting the control cap 21 to be forced downwards. When the control cap 21 is forced downwards, the spring 23 is forced to impart further downward pressure to the bottom of the piston 22, which consequently force down the pressure member 112*b,* causing the pressure member 112*b* to tilt the flap 112*a* (the pressure member 112*b* has a downward rod raised from the bottom near the border and stopped at the flap 112*a*) for letting outside air pass to the inside of the container 400.

FIG. 6 shows an alternate form of the sealing cap. This alternate form is designed to match with an extraction pump.

It is to be understood that the drawings are designed for purposes of illustration only, and are not intended as a definition of the limits and scope of the invention disclosed.

What the invention claimed is:

1. A sealing cap fastened to a vacuum seal container and controlled to extract air out of said vacuum seal container, the sealing cap comprising:

a cap body fastened to the vacuum seal container, said cap body comprising an inner upright tube perpendicularly raised from a top side thereof, an outer upright tube perpendicularly raised from the top side around said inner upright tube, a seat defined within said inner upright tube at a bottom side, a split coupling flange raised around the periphery of said outer upright tube near the topmost edge of said outer upright tube, two gaps defined at said split coupling flange at two opposite sides, a center air hole at the center of said seat, and a downward coupling flange raised from a bottom side thereof near the border;

a flap mounted in said seat inside said inner upright tube of said cap body;

a pressure member mounted inside said inner upright tube and forced to press on said flap, causing said flap to close said center air hole;

a ring cap covered on said outer upright tube and supported on said split coupling flange, said ring cap having two locating notches bilaterally disposed on the inside, and two downward coupling rods respectively engaged into the gaps in the split coupling flange of said cap body;

a rubber disk mounted within the downward coupling flange of said cap body and retained between said cap body and said vacuum seal container, said rubber disk having a neck inserted into the center air hole on the seat of said cap body;

a T-cap fastened to the neck of said rubber disk at a bottom side, said T-cap having a crossed stem raised from the center of a disk-like body thereof and inserted through the neck of said rubber disk;

a sponge mounted around the crossed stem of said T-cap and retained between said rubber disk and the disk-like body of said T-cap;

a piston mounted within the outer upright tube of said cap body, said piston comprising an outward bottom flange raised around the periphery at a bottom side, an outward upper flange raised around the periphery above said outward bottom flange, a rubber seal ring mounted around the periphery between said outward upper flange and said outward upper flange and disposed in contact with an inside wall of said outer upright tube of said cap body, two top notches bilaterally disposed at a top end thereof, an inside annular groove the top end, and a plurality of air gaps equiangularly spaced at said outward upper flange;

a spring mounted around said piston within said outer upright tube of said cap body, and stopped between said ring cap and said outward upper flange of said piston, said spring imparting a downward pressure to said piston, causing said piston to force down said pressure member; and a control cap covered on said piston above said ring cap, said control cap comprising an inside coupling flange forced into engagement with the inside annular groove on said piston, and two inside locating rods;

wherein air is extracted out of said vacuum seat container when said control cap is moved with the hand reciprocate said piston in between said outer upright tube and inner upright tube of said cap body; outside air is allowed to pass through said center air hole on said cap body into said vacuum seal container when said control cap is turned in one direction to move said inside locating rods into alignment with the locating notches on said ring cap and then pressed down to force said pressure member against said flap in causing said flap to be tilted in on direction.

* * * * *